US005435112A

United States Patent [19]

Goyet

[11] Patent Number: 5,435,112

[45] Date of Patent: Jul. 25, 1995

[54] METHOD FOR ANGULARLY POSITIONING AN ADJUSTABLE SEALING DEVICE RELATIVE TO A FLEXIBLE DISPENSING TUBE COMPRISING INDICIA

[75] Inventor: Daniel Goyet, Saint-Witz, France

[73] Assignee: L'Oreal, Paris, France

[21] Appl. No.: 75,574

[22] PCT Filed: Sep. 25, 1992

[86] PCT No.: PCT/FR92/00892

§ 371 Date: Jun. 3, 1993

§ 102(e) Date: Jun. 3, 1993

[87] PCT Pub. No.: WO93/07069

PCT Pub. Date: Apr. 15, 1993

[30] Foreign Application Priority Data

Oct. 3, 1991 [FR] France ..... 91 12181

[51] Int. Cl.[6] ..... B65B 7/14

[52] U.S. Cl. ..... 53/467; 53/51; 53/367; 53/411; 53/479; 53/485; 215/206; 215/230

[58] Field of Search ..... 53/51, 367, 411, 420, 53/467, 485, 489, 490, 477, 479; 215/206, 230, 276, 306, 320, 321, 325, 339, 332, 333; 220/256, 288

[56] References Cited

U.S. PATENT DOCUMENTS

| | | | |
|---|---|---|---|
| 3,129,834 | 4/1964 | Kimball | 215/206 |
| 3,611,662 | 10/1971 | Schmitt | 53/367 |
| 3,669,295 | 6/1972 | Horvath | 215/206 |
| 4,273,248 | 6/1981 | Lehmann . | |
| 4,285,186 | 8/1981 | Desom | 53/367 X |
| 4,335,074 | 6/1982 | Bernas | 220/228 X |
| 4,588,098 | 5/1986 | Uzdy | 215/230 |
| 4,687,113 | 8/1987 | Reeve | 215/230 |
| 5,040,691 | 8/1991 | Hayes et al. | 215/206 X |
| 5,046,630 | 9/1991 | Schneider et al. . | |
| 5,048,711 | 9/1991 | Weiss et al. | 215/230 X |
| 5,209,044 | 5/1993 | D'Addario et al. | 53/51 X |

FOREIGN PATENT DOCUMENTS

| | | |
|---|---|---|
| 0007274 | 1/1980 | European Pat. Off. . |
| 0410913 | 1/1991 | European Pat. Off. . |
| 2545448 | 11/1984 | France . |
| 4028360 | 3/1992 | Germany . |
| 494241 | 10/1938 | United Kingdom . |

*Primary Examiner*—John Sipos
*Assistant Examiner*—Daniel Moon
*Attorney, Agent, or Firm*—Staas & Halsey

[57] ABSTRACT

Method for angularly positioning an axially asymmetrical sealing device relative to a flexible tube for dispensing a substance with a liquid-to-pasty consistency. A neck of the tube supports the sealing device and dispenses the substance through a dispensing channel. The tube is provided with indicia relative to which the sealing device is located on the tube. The tube is adapted to be filled via its open bottom with the sealing device in place and then sealed by flattening and heat sealing its end opposite the neck. The tube also includes at least one reference marking and the sealing device is located on the tube relative to the reference marking, this reference marking being printed on the tube concurrently with the indicia. The reference marking is also used when squeezing and heat sealing the open end of the filled tube.

5 Claims, 1 Drawing Sheet

METHOD FOR ANGULARLY POSITIONING AN ADJUSTABLE SEALING DEVICE RELATIVE TO A FLEXIBLE DISPENSING TUBE COMPRISING INDICIA

BACKGROUND OF THE INVENTION

1. Field of the Invention

This invention relates to the packaging of oblong packs made of a malleable flexible material and sealed by a sealing device in order to hold a substance with a liquid to pasty consistency which is dispensed by finger pressure.

2. Description of the Related Art

Tubes of this kind were traditionally made of a malleable metal, such as aluminium. Nowadays, these tubes are often replaced by flexible thermoplastic tubes. Examples are toothpaste tubes, tubes for creams, gels and pastes in cosmetics and dermatology, tubes for food products, such as sauces or concentrated milks, or tubes for paints.

These tubes have a dispensing end including a neck defining a dispensing channel. The neck is provided with an external thread to receive a movable cap screwed on to the tube. However, these caps, generally of small dimensions, can be lost by the users and, in order to prevent this problem, it is proposed to replace the cap by a sealing device comprising a part adapted to be fixed to the neck of the tube, to which a movable part comprising the means for sealing the dispensing channel is hinged.

The mounting of an axially asymmetrical sealing device of this kind poses a problem of the adjustment of the sealing device relative to the body of the tube, as, in practice, the tube body always carries indicia, i.e. at least one inscription or drawing (trade mark, number, address, reference marking or the like) has been placed in at least one zone of the tube body. The sealing device must therefore be adjusted relative to the indicia of the body of the tube.

For packaging, the tubes are in the form of cylindrical sleeves ending at one end in the neck and open at their opposite ends. The tight sealing devices are mounted on the necks and the tubes are then turned upside down to be filled via their open bottoms. After filling, the bottoms are sealed tightly by squeezing the free ends of the tubes followed by heat sealing. In this operation, once again, it is necessary to monitor the position of the line along which squeezing is effected, as, after packaging, the tubes are flattened at their free ends so that they pass from their cylindrical shape to a shape substantially including an axial plane of symmetry. The tube body then comprises two areas substantially symmetrical relative to the axial plane of symmetry. In general, the mark of the product, the drawing or the graphics accompanying it and the name of the product appear on one of these areas, while the composition of the product and the accompanying information appear on the other area. The squeezing line is thus also adjusted relative to the indicia of the tube body.

A sealing device for a bottle is known from EP-B-7274, consisting, on the one hand, of an inner sealing capsule screwed on to the neck of the bottle and, on the other hand, of an outer cap integral with the capsule, both in translation by the cooperation of an outer peripheral bead of the capsule with an inner annular recess of the cap, and in rotation by the engagement of axial channels of the outer wall of the capsule in axial grooves of the inner wall of the cap, or vice versa. Means are provided for angularly positioning the cap relative to the bottle, as this sealing device is intended to be used on a bottle with a particular shape, so that it is desirable for the outer sides of the cap to be aligned with the outer sides of the bottle in order to form an aesthetically pleasing assembly. To this end, an area of excessive thickness forming a stop is disposed on the shoulder of the bottle between the neck and the body of the latter, and stop means are disposed in the lower part of the cap in the interior of the latter, the stop and the stop means comprising faces which are in contact with one another when the sealing device hermetically seals the bottle.

FR-A-2 541 654 also discloses a container provided at its upper end with a threaded neck to receive a sealing device consisting of a sealing capsule having an internal thread in order to cooperate by screwing with the neck, and an outer cap provided with an inner skirt integral in rotation and translation with the lateral skirt of the capsule, the container comprising a stop against which a stop member provided on the sealing device bears, so as to adjust the latter into the closed position relative to the container.

Therefore, in the two aforesaid cases, the angular positioning of the sealing device is effected by the cooperation of at least one element provided on the bottle at the neck or in the vicinity of the neck with at least one element provided on the sealing device.

SUMMARY OF THE INVENTION

In order to solve the problems set hereinabove of the angular positioning of the sealing device relative to a flexible tube provided with indicia, what first comes to mind is cooperation of the neck of the tube with the said sealing device, based on the prior art referred to hereinabove. However, according to this invention, the Applicant has discovered a different solution which does not necessitate modification of the mass-produced tubes and sealing devices in order to incorporate stops and stop members. This solution offers the additional advantage that it is also possible to ensure correct adjustment of the base of the tube relative to the indicia appearing on the tube when it is sealed by squeezing and heat sealing.

According to the invention, the tube comprises a reference marking printed on the tube concurrently with the indicia, allowing the sealing device to be mounted on the tube in the desired position as a function of the arrangement of the indicia prior to filling of the tube, the reference marking, after filling of the tube, also serving to position the latter prior to the squeezing of its free end and heat sealing.

Therefore, this invention relates to a method for angularly positioning an axially asymmetrical sealing device relative to a flexible tube for dispensing a substance with a liquid to pasty consistency, the neck of the said tube supporting the sealing device and dispensing the substance through a dispensing channel and being provided with indicia relative to which the sealing device is to be adjusted, the said tube being adapted to be filled via its open bottom with the said sealing device in place and then sealed by flattening and heat sealing of its end opposite the neck. At least one reference marking is formed on the tube, and the sealing device is mounted and adjusted relative to the said reference marking(s). The reference marking(s) is printed on the tube concurrently with the indicia, and the reference marking (s) is (are) used when squeezing and heat sealing the end of the filled tube in the desired position, taking account of the location of the indicia of the tube.

Moreover, the reference marking(s) is (are) preferably formed in the vicinity of the free edge of the tube opposite its neck. It is generally sufficient to form only one single reference marking on the tube. In this manner, in order to form a reference marking, a rectilinear mark disposed parallel to the axis of the tube can be formed over a short length relative to the length of the tube.

If a tube with a threaded neck is used, before mounting the sealing device, a ring having an internal thread adapted to cooperate with the external thread of the neck and provided on its exterior with means adapted to cooperate with complementary means provided on the sealing device in order to make the latter integral in rotation and in translation with the ring in the mounted position of the sealing device can be screwed on to the neck. Serrations provided externally on the ring and adapted to cooperate with complementary serrations provided on an inner cylindrical skirt of the sealing device can be used as means adapted to make the ring and the sealing device integral in rotation. An inner annular snap bead disposed along the lower free edge of the skirt can be used as means adapted to make the ring and the sealing device integral in translation.

The sealing device may comprise a fixed part adapted to be locked on to the neck of the tube, and a movable part hinged on to the fixed part and comprising means cooperating with the fixed part in order to seal the dispensing channel in the closed position of the tube. More precisely, it is possible to use a sealing device, the fixed part of which consists of a cap including a lateral wall connected to a base having an orifice defining the outlet of the dispensing channel, and the movable part of which consists of a folding cap hinged on to the fixed part by a film hinge and comprising a sealing skirt penetrating into the outlet orifice for the substance in the closed position of the sealing device.

BRIEF DESCRIPTION OF THE DRAWINGS

The method of this invention will be more readily understood from the following description of one embodiment given purely by way of a non-limiting example and with reference to the accompanying drawings, in which.

DESCRIPTION OF THE PREFERRED EMBODIMENTS

Figure 1:
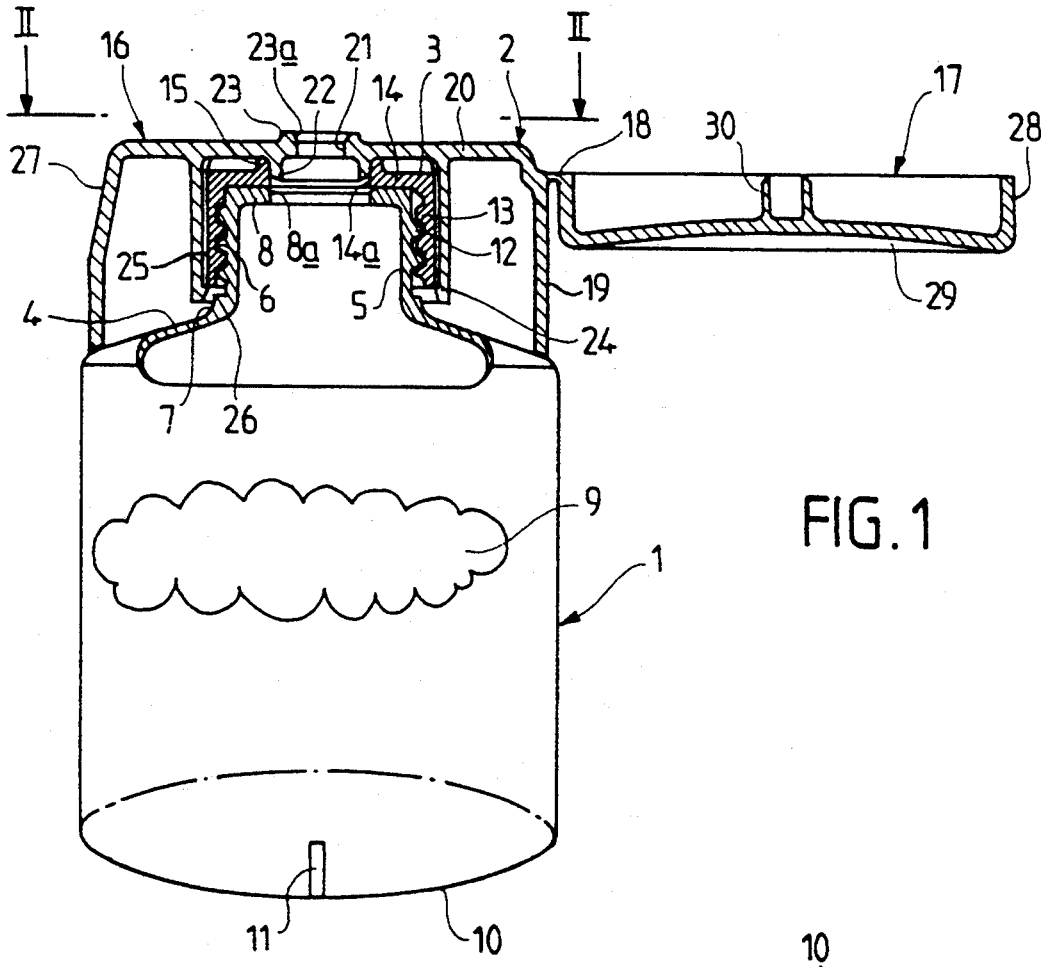
FIG. 1 is a partial view of a flexible tube for dispensing a pasty substance, the body of the tube being shown in a partial elevation prior to filling, i.e. with its bottom open, and the neck of the tube being shown in section with the sealing device in place and in the open position, the section plane being an axial plane perpendicular to the film hinge of the sealing device.
Figure 2:
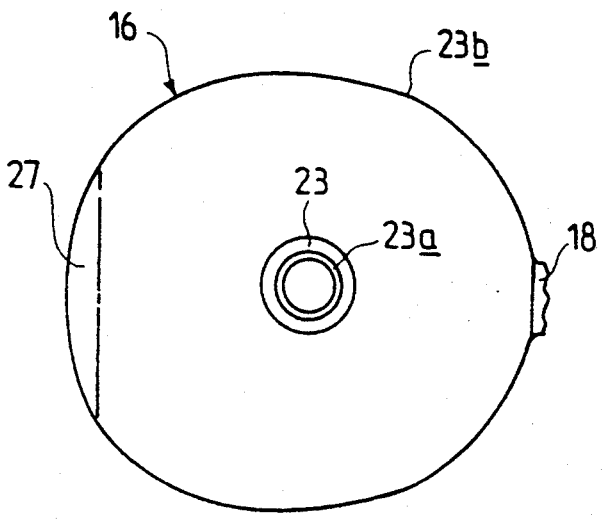
FIG. 2 is a partial top view along the line II—II of FIG. 1.

Referring to FIG. 1, it will be seen that the reference numeral 1 designates a tube of flexible thermoplastic which is adapted to hold a pasty substance, such as a toothpaste, and to which a sealing device 2 is fitted, with the interposition of a ring 3.

The tube 1 includes a cylindrical sleeve, on one end of which a truncated shoulder 4 is formed, this being extended by a cylindrical neck 5. The latter is provided with a thread 6 and an outer reinforcing bead 7 is provided in the zone of connection between the shoulder 4 and the neck 5. Moreover, the neck 5 is bent at a right angle towards the interior along its free edge in order to form an annular part 8 defining a circular opening **8*a***.

The tube 1 is provided on its body with an indicia marking zone indicated symbolically at 9 and along its free edge 10 opposite the neck 5 with a reference marking 11 formed by a rectilinear mark disposed parallel to the center axis of the sleeve over a short length.

The ring 3 is molded from a relatively rigid plastic. It comprises an internal thread 12 adapted to cooperate with the thread 6 of the neck 5. It is provided externally with axial serrations 13, the role of which is defined hereinafter. The ring 3 is bent at a right angle at its upper end, given the position of FIG. 1, in order to form an annular part 14 adapted to bear against the annular part 8 when the ring 3 is screwed on to the neck 5. The annular part 14 defines an opening **14*a* having a smaller diameter than the opening 8*a*. Moreover, the part 14 is bent towards the exterior of the neck in order to form a chimney 15**, the role of which is defined hereinafter.

The sealing device 2 molded in one piece from a relatively rigid plastic includes a fixed part 16 and a movable part 17 connected to the fixed part 16 by a film hinge 18.

The fixed part 16 consists of a cap comprising an outer lateral covering skirt 19 connected to a base 20. The base 20 has a central orifice 21 having a smaller diameter than the opening **14*a*. The orifice 21 is bordered in its interior by a sealing skirt 22 adapted to penetrate into the chimney 15 and on its exterior by a lip 23 having a truncated inlet 23*a* widening towards the exterior. An inner cylindrical skirt 24 is connected to the base 20, said skirt 24 being provided in its interior with axial serrations 25 adapted to be placed between the serrations 13 of the ring 3 in order to form a system of anti-rotation grooves and channels together therewith when the sealing device 2 is pressed on to cover the ring 3 as shown in FIG. 1. Moreover, the cylindrical skirt 24 is provided along its free lower edge with an inner bead 26 for the snap engagement of the skirt 24 under the lower edge of the ring 3 in the mounted position shown in FIG. 1**.

The lateral covering skirt 19 has a substantially cylindrical shape but opposite the film hinge 18 it comprises an inclined part 27 serving for handling of the movable part 17 which forms a sealing cap. The latter comprises a lateral wall 28 connected to a base 29 displaying concavity directed towards the exterior in the closed position of the tube 1. The base 29 is provided in its interior with a cylindrical skirt 30 adapted to penetrate into the dispensing channel for the substance, defined by the lip 23 and the skirt 22.

The substance is packed in the tube 1 as follows.

A decorated tube as shown in FIG. 1 is used. The ring 3 is screwed thereto until the annular part 14 bears against the annular part 8. A sealing device 2, the movable part 17 of which is hinged is then placed above the neck 5 provided in this manner with the ring 3. It is placed in a predetermined position relative to the reference marking 11 which is optically detected. The device 2 is then pressed on to the ring 3 until the annular snap bead 26 is fixed under the free edge of the ring 3. The cooperation of the serrations 13 and 25 holds the sealing device 2 in the correct position on the tube. The reference marking 11 therefore allows the sealing device 2 to be positioned relative to the indicia 9 of the tube 1.

Figure 3:
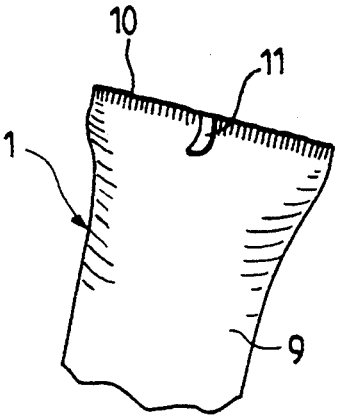
FIG. 3 is a perspective view of the base of the tube after closure by heat sealing.

The tube 1 is then turned upside down to be filled via its open bottom. Linear squeezing of the open end of the filled tube is then effected along an axial plane perpendicular to the plane defined by the axis of the tube 1 and the reference marking 11. It is sealed by heat sealing in order to obtain a tube base as shown in FIG. 3. The reference marking 11 therefore also serves to position the tube 1 prior to heat sealing.

The embodiment described hereinabove is of course in no way limiting and is subject to any desired modifications without thereby going beyond the scope of the invention.

I claim:

1. A method for angularly positioning an axially asymmetrical sealing device relative to a first end of a flexible tube for dispensing a substance with a liquid-to-pasty consistency, said tube having a neck supporting said sealing device and defining a dispensing channel, comprising the steps of:

forming indicia on the tube;

forming at least one reference marking on the tube concurrently with the formation of the indicia;

forming the neck with an external thread;

forming a ring with an internal thread adapted to cooperate with the external thread of the neck and, on an exterior of the ring, serrations adapted to cooperate with complementary serrations provided on an inner cylindrical skirt of the sealing device in order to fix the sealing device against movement relative to said ring;

screwing said ring onto said neck via said threads;

forming the sealing device to further include a fixed part having an orifice fluid connection with the dispensing channel and being adapted to be connected to the neck of the tube, and a movable part which is a folding cap hinged to said fixed part by a film hinge and including a sealing skirt which penetrates into said orifice to seal the dispensing channel; and pushing said sealing device on the neck with the ring interposed therebetween;

using said at least one reference marking and indicia to locate the sealing device in a predetermined position relative to the tube;

using said at least one reference marking to locate the tube in a predetermined position for filling and sealing of the tube;

then filling said tube via a second, open end of the tube opposite the neck; and then flattening and heat sealing said second end.

2. Method according to claim 1, wherein said at least one reference marking is formed at said second end of the tube.

3. Method according to claim 1, wherein said at least one reference marking is one reference marking.

4. Method according to claim 1, wherein said at least one reference marking is a rectilinear mark formed parallel to an axis of said tube over a length shorter than a length of tube.

5. Method according to claim 1, wherein the inner cylindrical skirt is provided with an inner annular snap bead disposed along a lower free edge thereof, said snap bead being adapted to cooperate with a lower edge of the ring.

* * * * *